US008770073B2

(12) United States Patent
Fukatsu et al.

(10) Patent No.: US 8,770,073 B2
(45) Date of Patent: Jul. 8, 2014

(54) SHEET PUNCHING APPARATUS AND CONTROL METHOD THEREOF

(75) Inventors: Yasuo Fukatsu, Abiko (JP); Hitoshi Kato, Toride (JP); Naoki Ishikawa, Kashiwa (JP)

(73) Assignee: Canon Kabushiki Kaisha (JP)

( * ) Notice: Subject to any disclaimer, the term of this patent is extended or adjusted under 35 U.S.C. 154(b) by 727 days.

(21) Appl. No.: 12/907,911

(22) Filed: Oct. 19, 2010

(65) Prior Publication Data

US 2011/0107886 A1 May 12, 2011

(30) Foreign Application Priority Data

Nov. 10, 2009 (JP) ..... 2009-257180

(51) Int. Cl.
*B26D 1/00* (2006.01)
*B26F 1/14* (2006.01)

(52) U.S. Cl.
USPC ..... 83/13; 83/620; 83/628; 83/684; 83/691; 83/694

(58) Field of Classification Search
USPC ..... 83/620, 628, 691, 694, 687, 518, 624; 270/58.07; 234/50, 1, 76.8
See application file for complete search history.

(56) References Cited

U.S. PATENT DOCUMENTS

| | | | | |
|---|---|---|---|---|
| 6,622,908 | B2 * | 9/2003 | Fukumoto et al. | 234/98 |
| 6,978,925 | B2 * | 12/2005 | Morson | 234/1 |
| 7,172,185 | B2 | 2/2007 | Hattori et al. | |
| 7,458,505 | B2 * | 12/2008 | Majima et al. | 234/98 |
| 7,823,494 | B2 * | 11/2010 | Baba | 83/628 |
| 2001/0011492 | A1 * | 8/2001 | Fukumoto et al. | 83/549 |

* cited by examiner

*Primary Examiner* — Omar Flores Sanchez
(74) *Attorney, Agent, or Firm* — Rossi, Kimms & McDowell LLP

(57) ABSTRACT

A sheet punching apparatus capable of improving the accuracy of movement distance of a movable member and maintaining the durability of a drive unit of the apparatus. A sheet post-processing apparatus controller computes a time period corresponding to an amount of overrun of a slider at the time of stopping the slider in an initial operation. In a punching operation, the sheet post-processing apparatus controller starts a punch motor at a timing earlier by the computed time period corresponding to the amount of overrun than a stop timing of a conveyance motor.

9 Claims, 16 Drawing Sheets

SHEET PUNCHING APPARATUS AND CONTROL METHOD THEREOF

BACKGROUND OF THE INVENTION

1. Field of the Invention

The present invention relates to a sheet punching apparatus for punching a sheet and a control method thereof.

2. Description of the Related Art

The sheet punching apparatus is classified into a press punch type for punching conveyed recording sheets one sheet by one sheet while temporarily stopping sheet conveyance and a rotary type for punching recording sheets without stopping sheet conveyance. The press punch type is generally more accurate in punched hole position and smaller in variation in punched hole position than in the rotary type.

To make the apparatus compact in size and reduced in cost, a punch drive motor comprised of a DC motor is used in the sheet punching apparatus. However, the DC motor is lower in stop accuracy as compared to a pulse motor and hence produces a large variation in stop position from a target stop position.

In order to suppress a variation in stop position, a punching apparatus described in U.S. Pat. No. 7,172,185 is configured to start, immediately after start of a punch motor, a time measurement in which pulses are counted by an encoder attached to the punch motor, and applies brake to the motor upon lapse of a predetermined time from the start of the motor.

The punching apparatus described in the U.S. patent causes the punch motor to restart so as to bring a punch blade close to a desired position, if a punch blade position detected at the time of or prior to a motor stop deviates from the desired position, thereby improving the accuracy of motor stop position.

Although the punching apparatus described in the U.S. patent is suitable for correction of a variation (individual difference) of the apparatus (punch motor), operation of the apparatus is liable to vary even if the apparatus operates at the same load. Thus, even when a timing at which brake is started to be applied to the punch motor is kept the same, the punch motor (a movable part of the apparatus) does not always stop at the same position, and therefore the accuracy of movement distance of the movable part is not high. FIG. 16 is a timing chart of a punch motor stop operation that entails a variation in motor stop position due to repetitive operations.

With the punching apparatus described in the U.S. patent that restarts the punch motor (DC brush motor) to correct a deviation of the stop position of the punch blade, the motor is repeatedly started and stopped, and therefore the service life of the motor is shortened, posing a problem that component parts of the apparatus must frequently be replaced and the maintenance cost of the apparatus increases.

SUMMARY OF THE INVENTION

The present invention provides a sheet punching apparatus and a control method thereof, which are capable of improving the accuracy of movement distance of a movable member of the apparatus and maintaining the durability of a drive unit of the apparatus.

According to a first aspect of this invention, there is provided a sheet punching apparatus for punching a sheet, which comprises a punch configured to punch a sheet by being moved, a movable member configured to move in a predetermined direction to thereby move the punch, a drive unit configured to move the movable member in the predetermined direction, a position detection unit configured to detect that the movable member is at a predetermined position, a stop control unit configured, in response to the position detection unit detecting that the movable member reaches the predetermined position after movement of the movable member is started by the drive unit, to stop an operation of the drive unit to thereby stop the movement of the movable member, and a timing decision unit configured to decide a next start timing of movement of the movable member based on a position where the movable member is stopped by the stop control unit.

According to a second aspect of this invention, there is provided a control method of the sheet punching apparatus described in the first aspect.

With this invention, a start timing of next movement of the movable member is decided based on a stop position of the movable member, e.g., a difference between a first movement amount of the movable member from the start of movement of the movable member until the movable member reaches the predetermined position and a second movement amount of the movable member from the start of movement of the movable member until the movable member is stopped. By changing the next start timing (i.e., distance) of movement of the movable member according to the stop position of the movable member, it is possible to improve the accuracy of movement distance of the movable member and shorten a substantial drive time of the drive unit. It is therefore possible to improve the accuracy of movement distance of the movable member and the durability of the drive unit even by using the drive unit comprised of a DC motor.

Further features of the present invention will become apparent from the following description of an exemplary embodiment with reference to the attached drawings.

DESCRIPTION OF THE EMBODIMENTS

The present invention will now be described in detail below with reference to the drawings showing a preferred embodiment thereof.

Figure 1:
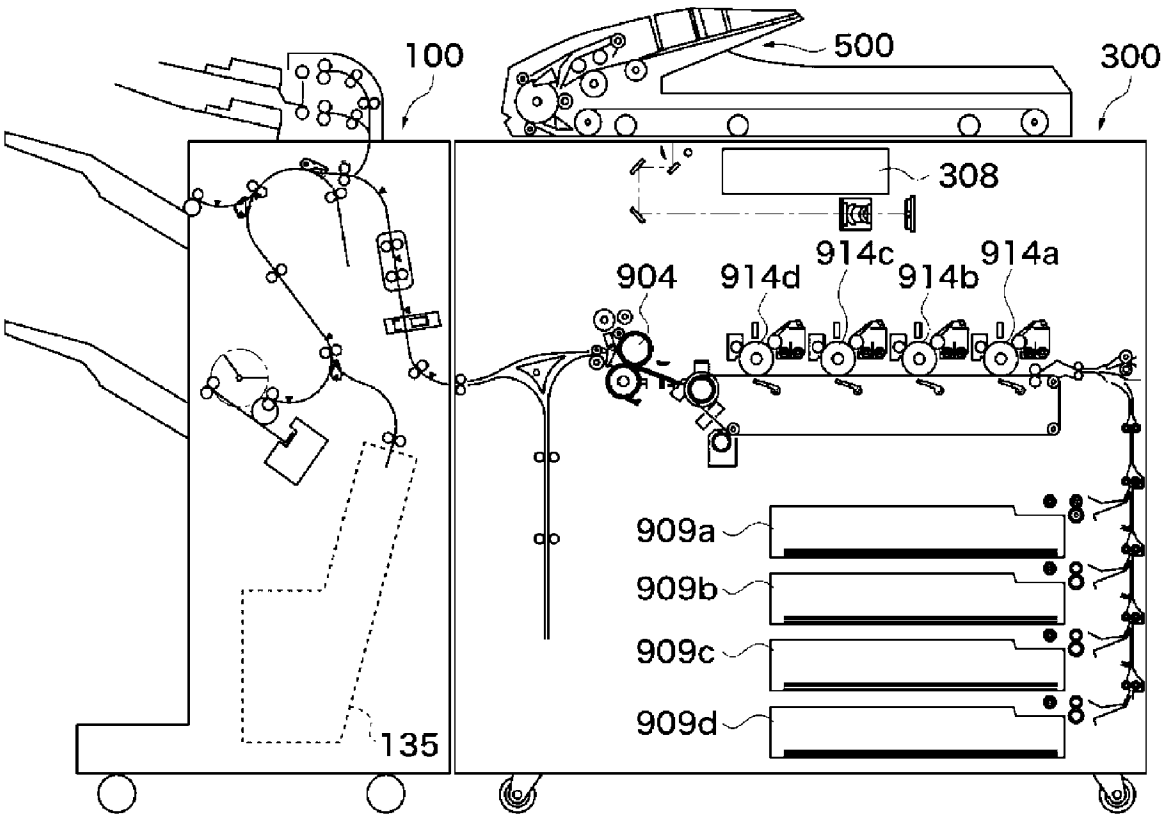
FIG. 1 is a vertical section view showing the overall construction of an image forming system including an image forming apparatus having a sheet post-processing apparatus mounted with a sheet punching apparatus according to one embodiment of this invention.

FIG. 1 shows in vertical section the overall construction of an image forming system. The image forming system includes an image forming apparatus 300, an automatic original feeding apparatus 500, and a sheet post-processing apparatus (hereinafter, referred to as the post-processing apparatus) 100 that is mounted with a sheet punching apparatus according to one embodiment of this invention.

The post-processing apparatus 100 is coupled to the image forming apparatus 300 and includes a saddle-stitching unit (saddle unit) 135 and a side-stitching unit (as a sheet stacking unit). The post-processing apparatus 100 and the image forming apparatus 300 can be configured integrally with each other.

The image forming apparatus 300 includes cassettes 909*a* to 909*d*, an image forming unit having photosensitive drums 914*a* to 914*d* for yellow, magenta, cyan, and black, and an operation unit 308. Toner images of four colors formed on the photosensitive drums 914*a* to 914*d* are transferred to a sheet supplied from any of the cassettes 909*a* to 909*d*. The sheet is conveyed to a fixing unit 904 where the toner images are fixed to the sheet, and is then conveyed to the post-processing apparatus 100.

Figure 2:
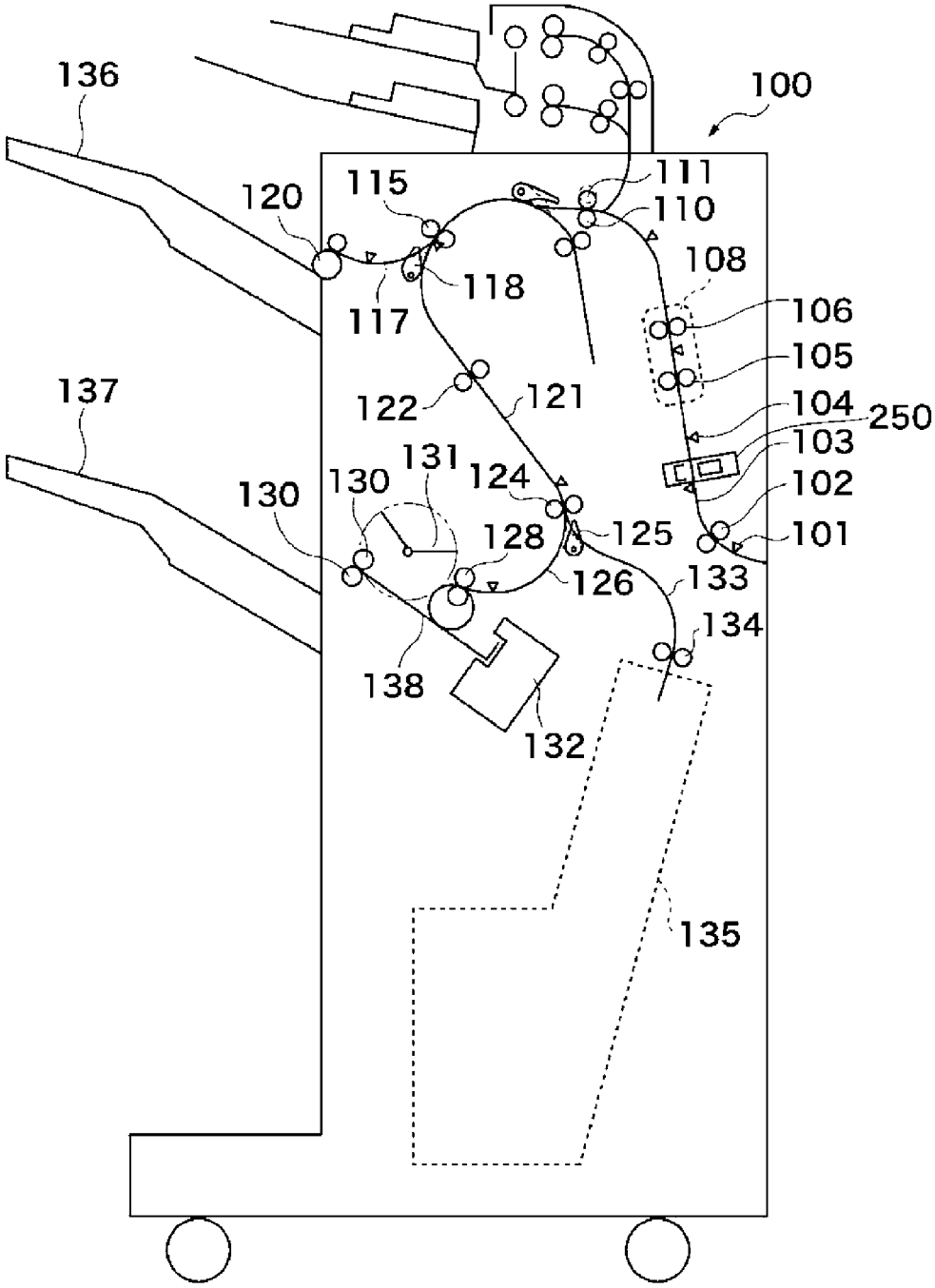
FIG. 2 is a vertical section view showing the internal construction of the sheet post-processing apparatus.

FIG. 2 shows in vertical section the internal construction of the post-processing apparatus 100. A sheet discharged from the image forming apparatus 300 is delivered to the post-processing apparatus 100 and received by a pair of inlet rollers 102 of the apparatus 100, and a sheet receipt timing is detected by an inlet sensor 101. When the sheet conveyed by the inlet roller pair 102 passes through a conveyance path 103, a lateral end detection sensor 104 detects a sheet end position in a width direction perpendicular to the sheet conveyance direction. Based on the detected sheet end position, an amount of lateral shift of the sheet is determined.

To correct the lateral shift, the sheet is moved in a front-to-rear direction by a shift unit 108 while being conveyed by pairs of shift rollers 105, 106. A predetermined number of holes can be punched at an edge portion of the sheet by a punch unit 250 (punching apparatus), as needed. The sheet is then conveyed by a conveyance roller 110, a separation roller 111, and a pair of buffer rollers 115, and further conveyed to an upper conveyance path 117 or to a bundle conveyance path 121.

To guide the sheet to the upper conveyance path 117, an upper path changeover flapper 118 is switched by a solenoid (not shown) to a position (not shown). Thereafter, the sheet is conveyed through the upper conveyance path 117 by an upper sheet discharge roller 120 to an upper tray 136.

On the other hand, to guide the sheet to the bundle conveyance path 121, the upper path changeover flapper 118 is switched to the position shown in FIG. 2. Thereafter, the sheet is conveyed through the bundle conveyance path 121 by a pair of buffer rollers 122 and a pair of bundle conveyance rollers 124.

Subsequently, to perform saddle processing on the sheet, a saddle path changeover flapper 125 is switched to a position (not shown) by a solenoid (not shown). Then, the sheet is conveyed to a saddle path 133 and guided by a pair of saddle inlet rollers 134 to the saddle unit 135 where it is subjected to the saddle processing. Since the saddle processing is ordinary processing and does not relate to the gist of this invention, a description thereof is omitted.

On the other hand, to discharge the sheet to a lower tray 137, the saddle path changeover flapper 125 is switched to the position shown in FIG. 2. Thereafter, the sheet is conveyed to a lower path 126 by the bundle conveyance roller pair 124, and then discharged to an intermediate processing tray 138 by a pair of lower sheet discharge rollers 128. On the intermediate processing tray 138, sheets are aligned into a sheet bundle by a paddle 131 and a knurled belt (not shown). The sheet bundle is stitched by a stapler 132 as needed, and discharged to the lower tray 137 by a pair of bundle discharge rollers 130.

Next, a description will be given of the construction and operation of the punch unit 250 as the punching apparatus.

Figure 3A:
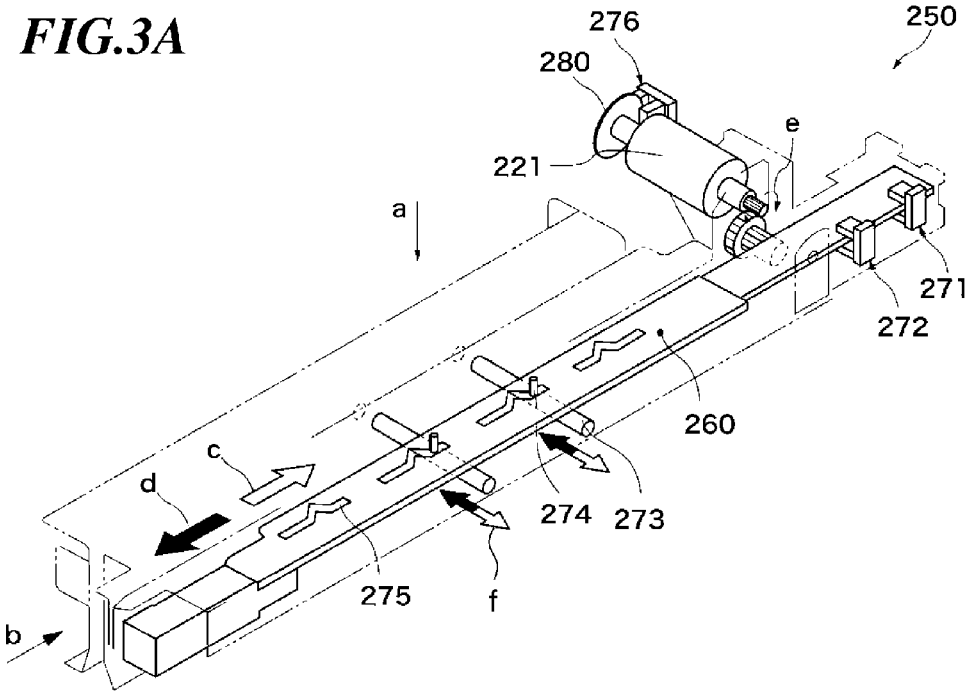
FIG. 3A is a perspective view showing the internal construction of a punch unit of the sheet post-processing apparatus in a state where two punch home position sensors are light-intercepted by a light interception member of a slider of the punch unit.
Figure 3B:
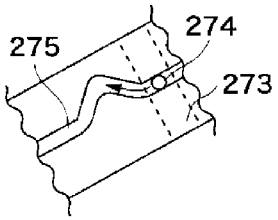
FIG. 3B is a fragmentary plan view showing a positional relation between a pin and a cam groove of the punch unit as viewed in a direction of arrow a in FIG. 3A.
Figure 3C:
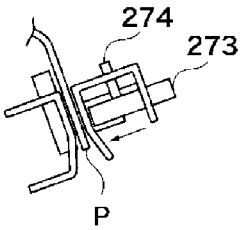
FIG. 3C is a fragmentary side view showing a positional relation between a sheet and a punch of the punch unit as viewed in a direction of arrow b in FIG. 3A.
Figure 4A:
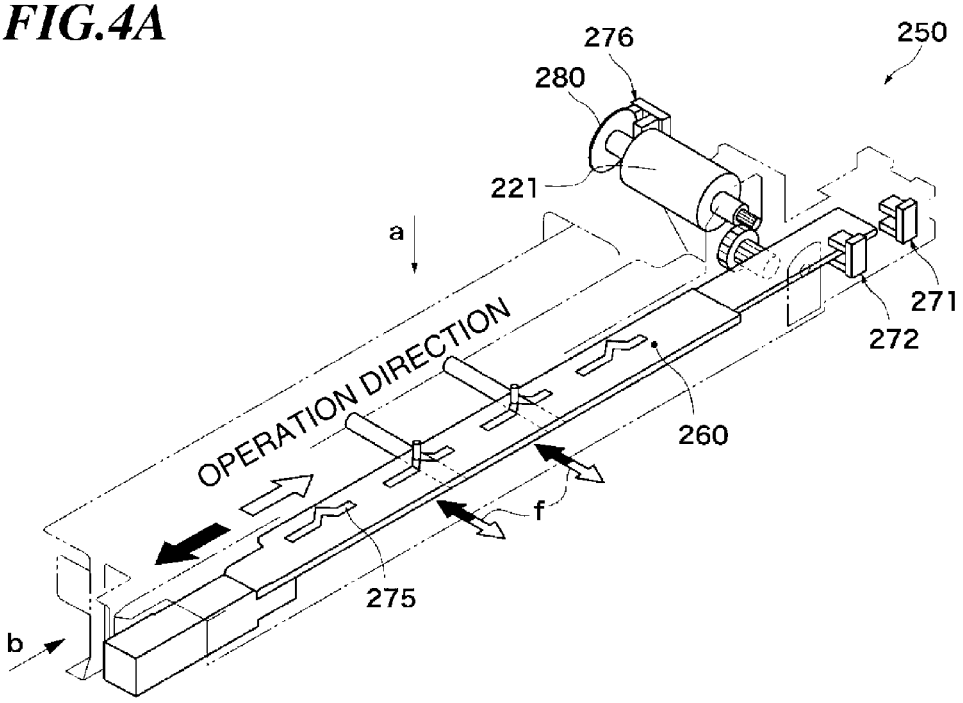
FIG. 4A is a perspective view showing the internal construction of the punch unit in a state where one of the sensors is light-intercepted by the light interception member.
Figure 4B:
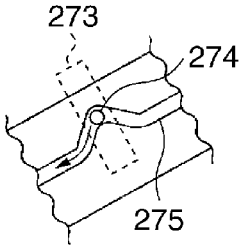
FIG. 4B is a fragmentary plan view showing a positional relation between a pin and a cam groove as viewed in a direction of arrow a in FIG. 4A.
Figure 4C:
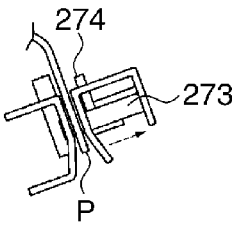
FIG. 4C is a fragmentary side view showing a positional relation between a sheet and a punch as viewed in a direction of arrow b in FIG. 4A.
Figure 5A:
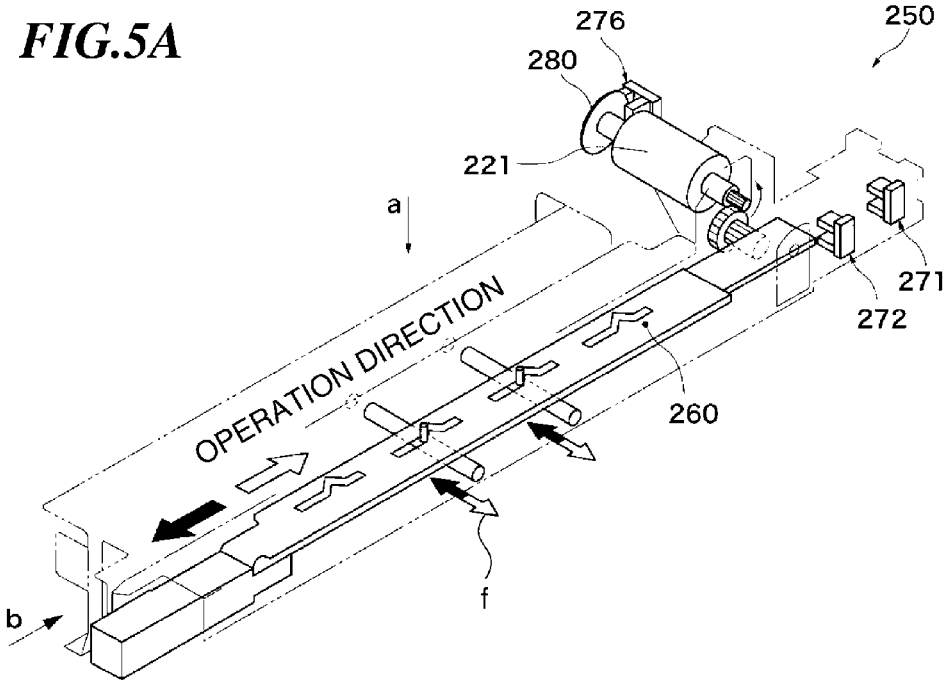
FIG. 5A is a perspective view showing the internal construction of the punch unit in a state where the two punch home position sensors are not light-intercepted by the light interception member.
Figure 5B:
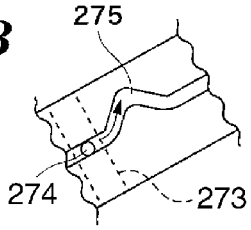
FIG. 5B is a fragmentary plan view showing a positional relation between a pin and a cam groove as viewed in a direction of arrow a in FIG. 5A.
Figure 5C:
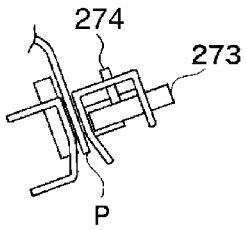
FIG. 5C is a fragmentary side view showing a positional relation between a sheet and a punch as viewed in a direction of arrow b in FIG. 5A.

FIGS. 3A, 4A, and 5A show in perspective view the internal construction of the punch unit 250 in respective states where two punch home position sensors are light-intercepted by a light interception member of a slider of the punch unit 250, where one of the sensors is light-intercepted, and where none of the sensors are light-intercepted. FIGS. 3B, 4B, and 5B each show a positional relation between one of pins and a corresponding one of cam grooves of the punch unit 250 as viewed in a direction of arrow a in FIGS. 3A, 4A, and 5A. FIGS. 3C, 4C, and 5C each show a positional relation between a sheet and one of punches of the punch unit 250 as viewed in a direction of arrow b in FIGS. 3A, 4A, and 5A.

The punch unit 250 includes a slider 260, punches 273 movable in a punching direction, a punch motor 221, a punch home position 1 sensor (hereinafter, referred to as the first HP sensor) 271, and a punch home position 2 sensor (hereinafter, referred to as the second HP sensor) 272. The first and second HP sensors 271, 272 each comprised of a transmittive photo-interrupter are for determining a position of the slider 260 (movable member). If both the HP sensors 271, 272 are light-intercepted by the slider 260 as shown in FIG. 3A, it is determined that the slider 260 is located on a rear side in the direction of arrow b.

If none of the HP sensors 271, 272 are light-intercepted as shown in FIG. 5A, it is determined that the slider 260 is located on a front side in the direction of arrow b. The first and second HP sensors 271, 272 are an example of a position detection unit for detecting that the slider 260 is at a first position on the rear side after forward movement of the slider and that the slider is at a second position on the front side after backward movement of the slider.

The slider 260 is driven by the punch motor 221 so as to be reciprocated in directions c and d in FIG. 3A. For example, the slider 260 is moved backward in the direction d when the punch motor 221 rotates clockwise as indicated by arrow e. At that time, pins 274 (projections) fixed to the punches 273 and extending through cam grooves 275 formed in the slider 260 are moved from positions shown in FIGS. 3A and 3B along the cam grooves 275 in a direction perpendicular to the moving direction of the slider 260. The punches 273 to which the pins 274 are fixed are moved as shown by arrow f in FIG. 3A in a direction perpendicular to a surface of a sheet (shown by symbol P in FIGS. 3C, 4C, and 5C), whereby the sheet is punched. Subsequently, the slider 260 is moved to a position shown in FIG. 5A.

As shown in FIGS. 3A, 4A, and 5A, a plurality of cam grooves 275 are formed in the slider 260, and the pins 274 of the punches 273 are inserted through respective ones of the punches 273. In this embodiment, to punch a predetermined number of holes in a sheet by one punching operation, the slider is provided with the predetermined number of (e.g., four) cam grooves 275 and the predetermined number of punches 273 (only two punches 273 are shown for convenience of illustration).

An encoder 280 is fixed to a rear end of an output shaft of the punch motor 221. With rotation of the punch motor 221, a punch motor clock sensor 276, which is comprised of a transmittive photointerrupter, generates a punch motor clock pulse (hereinafter, referred to as the clock pulse) each time one slit of a slit pattern of the encoder 280 has passed the sensor 276. By counting the clock pulses, an amount of rotation of the punch motor 221, i.e., an amount of movement of the slider 260, is detected. While the slider 260 is moved by a predetermined distance, one punching operation is carried out. In this embodiment, a sheet is punched when the slider 260 is moved from the front side to the rear side. After the next sheet is set in the punch unit, this sheet is punched when the slider 260 is moved from the rear side to the front side.

Figure 6:
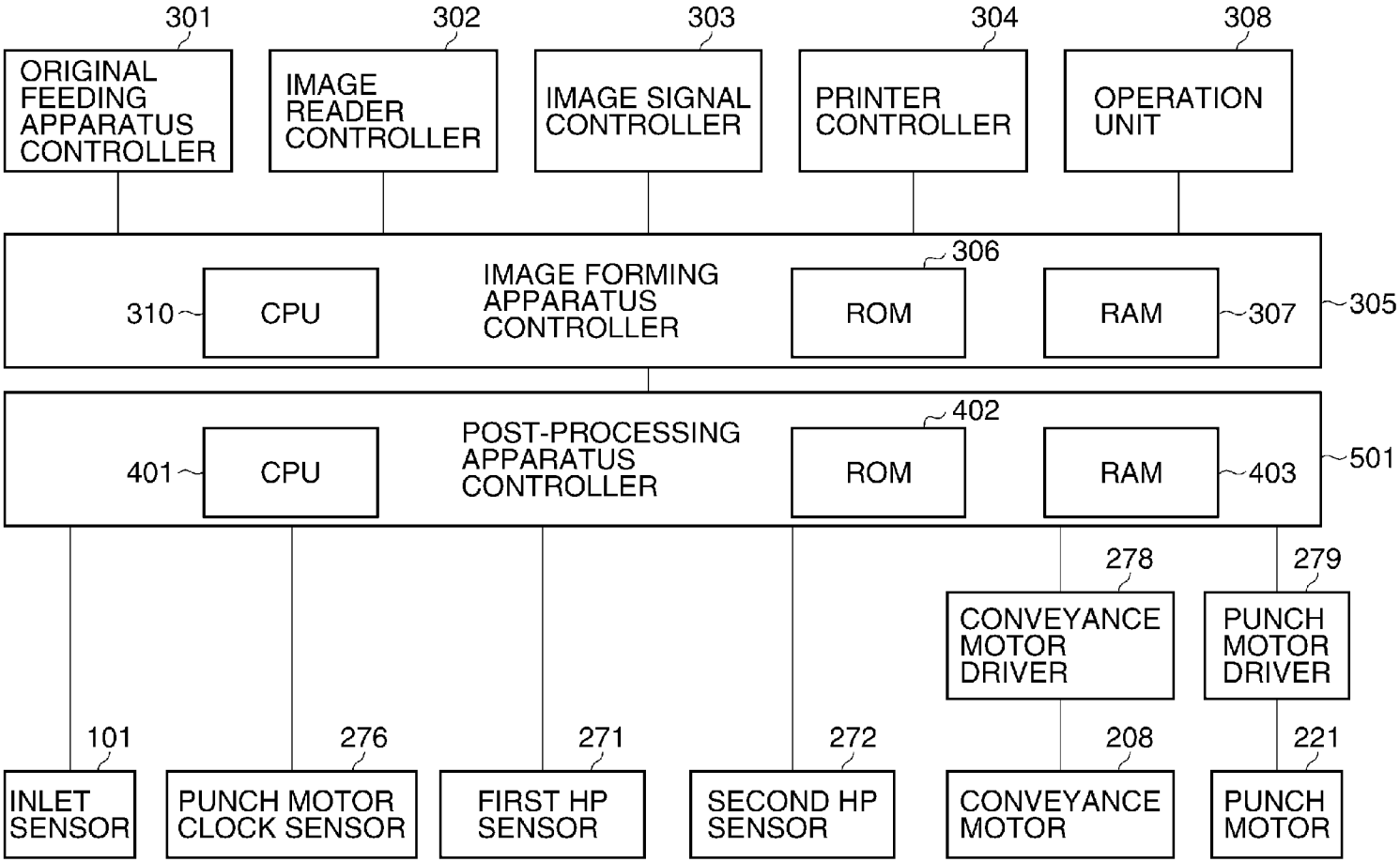
FIG. 6 is a block diagram showing the construction of controllers of the image forming apparatus and the sheet post-processing apparatus, together with peripheral elements of the controllers.

FIG. 6 shows in block diagram the construction of controllers of the image forming apparatus 300 and the post-processing apparatus 100, together with peripheral elements of the controllers. An image forming apparatus controller 305 incorporates a CPU 310, ROM 306, and RAM 307. The CPU 310 executes a control program stored in the ROM 306, thereby performing overall control of an original feeding apparatus controller 301, image reader controller 302, image signal controller 303, printer controller 304, operation unit 308, and post-processing apparatus controller 501, which are connected to the image forming apparatus controller 305. The RAM 307 temporarily stores control data and is used as a work area for arithmetic processing for the control.

The original feeding apparatus controller 301 drives and controls the automatic original feeding apparatus 500 (see, FIG. 1) according to instructions given by the image forming apparatus controller 305. The image reader controller 302 drives and controls an optical system including alight source, lenses, and image pickup device, and transfers to the image signal controller 303 an analog RGB image signal output from the image pickup device. Under the control of the image forming apparatus controller 305, the image signal controller 303 converts the analog RGB image signal into a digital signal, performs various processing on the digital signal to convert the digital signal into a video signal, and outputs the video signal to the printer controller 304. The operation unit 308 includes keys for setting image forming functions, a display device for displaying setting state information, and the like. Key signals corresponding to key operations on the operation unit 308 are supplied to the image forming apparatus controller 305. Information corresponding to a signal from the controller 305 is displayed on the display device of the operation unit 308.

The post-processing apparatus controller 501 is mounted on the post-processing apparatus 100 and performs data communication with the image forming apparatus controller 305 via a communication IC (not shown) to control the operation of the post-processing apparatus 100. The post-processing apparatus controller 501 includes a CPU 401, ROM 402, and RAM 403.

The CPU 401 executes a control program stored in the ROM 402 to control various actuators and sensors (for example, the inlet sensor 101, and a conveyance motor 208 for driving the inlet roller pair 102 and the shift roller pairs 105, 106). A punch motor driver 279, conveyance motor driver 278, first HP sensor 271, second HP sensor 272, and punch motor clock sensor 276 are connected to the post-processing apparatus controller 501. The punch motor driver 279 drives the punch motor 221. The conveyance motor driver 278 drives the conveyance motor 208. The RAM 403 temporarily stores control data and is used as a work area for arithmetic processing for the control.

Figure 7:
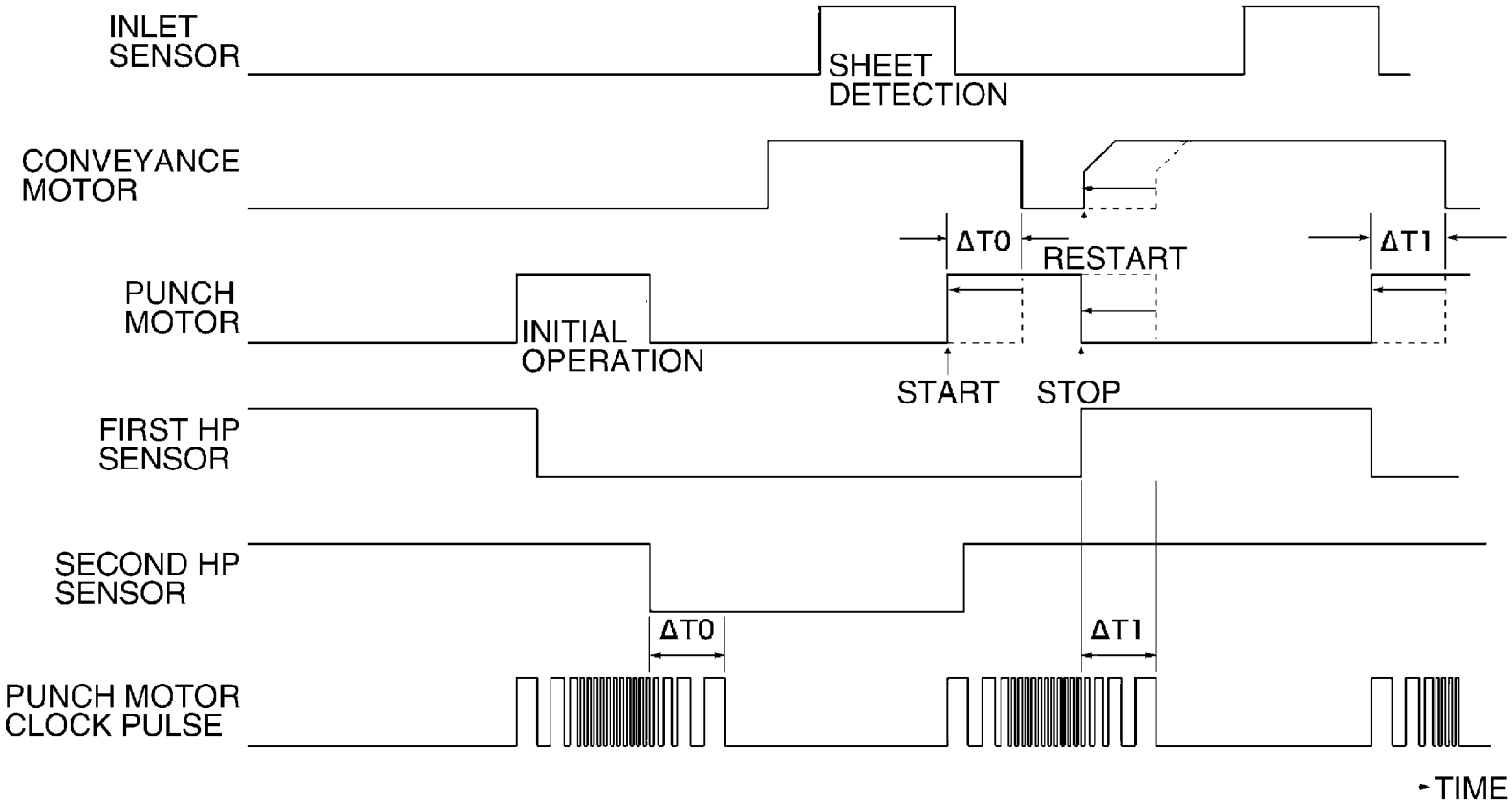
FIG. 7 is a timing chart showing changes of signals at various parts of the punch unit in a case that an initial operation is started from a state where the slider is stopped at a position shown in FIG. 3A and a punching operation is performed in succession to the initial operation.

Next, a description will be given of an initial operation and a punching operation of the punch unit 250. FIG. 7 is a timing chart showing changes of signals at various parts of the punch unit in a case that the initial operation is started from a state where the slider 260 is stopped at the position shown in FIG. 3A and the punching operation is performed in succession to the initial operation.

When a user selects execution of punching operation and instructs copy start, the post-processing apparatus controller 501 performs the initial operation of the punch unit 250, including checking whether the punch unit 250 normally operates. In the initial operation, the post-processing apparatus controller 501 starts the punch motor 221 to rotate the motor output shaft clockwise in order to move the slider 260 from the position shown in FIG. 3A to the position shown in FIG. 5A.

With movement of the slider 260 caused by the rotation of the punch motor 221, the light interception member of the slider 260 gets out of the first HP sensor 271 and therefore the sensor 271 is turned off (low level). With further movement of the slider 260, the light interception member of the slider 260 gets out of the second HP sensor 272, and the sensor 272 is turned off. At that time, the post-processing apparatus controller 501 stops driving the punch motor 221.

Figure 8:
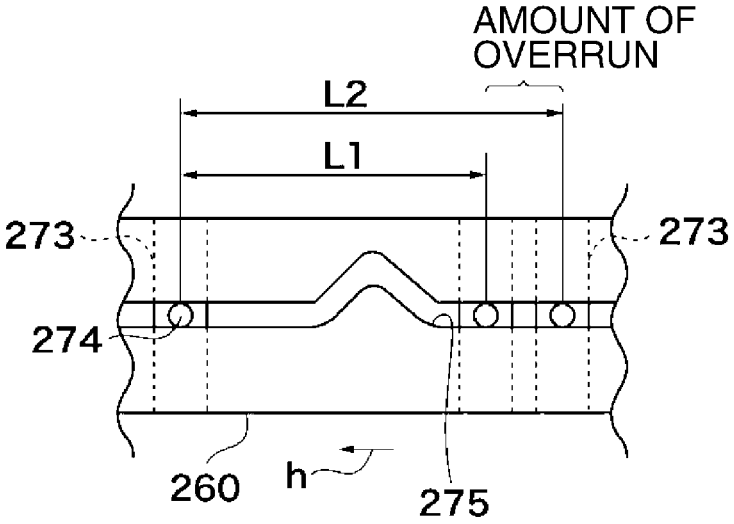
FIG. 8 is a view showing a change in positional relation between the cam groove and the pin at the initial operation.

FIG. 8 shows a change in positional relation at the initial operation between one of the cam grooves 275 formed in the slider 260 and a corresponding one of the pins fixed to the punches 273. In the initial operation, when the slider 260 is moved in a direction shown by arrow h in FIG. 8, the pin 274 moves along the cam groove 275 relative to the slider 260. At the time of stopping the rotation of the punch motor 221, brake is applied to the motor 221. Nevertheless, the punch motor 221 does not immediately stop and overruns to a rotational position corresponding to a distance L2 (second movement amount) larger than a distance L1 (first movement amount) from a movement start position to a target stop position. An amount of overrun (corresponding to the distance difference (L2–L1)) corresponds to an actual stop position of the slider 260, and corresponds to a time period ΔT0 shown in FIG. 7.

During the initial operation, the CPU 401 counts pulses supplied from the punch motor clock sensor 276 to measure the time period ΔT0. In other words, the CPU 401 and the clock sensor 276 function as a movement amount detection unit.

It should be noted that the above description is applied not only to the initial operation, but also to a punching operation in which the slider 260 is moved in the direction shown by arrow h.

After completion of the initial operation, the conveyance motor 208 is driven (see, FIG. 7) to thereby convey a sheet into the post-processing apparatus 100. When the front end of the sheet reaches the inlet sensor 101, an output signal of the sensor 101 becomes a high level. When the rear end of the sheet has passed the inlet sensor 101, the output signal of the sensor 101 becomes a low level and the post-processing apparatus controller 501 stops the conveyance motor 208 (see, FIG. 7). It should be noted that by using the conveyance motor 208 comprised of a stepping motor, the drive of the motor can be controlled with accuracy and each sheet can be stopped substantially at a target position.

In a punching operation of a press punch type punching apparatus, the punch motor 221 is usually started after the conveyance motor 208 is stopped, as shown by chain lines in FIG. 7. On the other hand, in this embodiment, the time period ΔT0 corresponding to the amount of overrun at the time of stopping the slider 260 is determined in the initial operation, as previously described. Subsequently, in the punching operation, the post-processing apparatus controller 501 starts the punch motor 221 at a timing earlier by the time period ΔT0 than a stop timing of the conveyance motor 208 (see, FIG. 7), thereby preventing a delay (corresponding to the amount of overrun) in starting the punching operation. In other words, the time period ΔT0 is used as a correction value for the start timing of the punch motor 221.

As compared to a case where the punch motor 221 is started after the stop of the conveyance motor 208, the punch motor 221 is started at a timing earlier by the time period ΔT0, as shown by leftward arrows in FIG. 7. Accordingly, the punching operation can be completed earlier by the time period ΔT0. Since the amount of overrun can be known in advance, a time period of operation of the punch motor 221 (the movement distance of the slider 260) for punching a conveyed sheet can be made proper with accuracy.

After the start of the punch motor 221, the second HP sensor 272 is turned on by the movement of the slider 260 caused by the motor rotation and then the first HP sensor 271 is turned on. In response to the sensor 271 being turned on, the post-processing apparatus controller 501 stops the punch motor 221 (see, FIG. 7).

Figure 9:
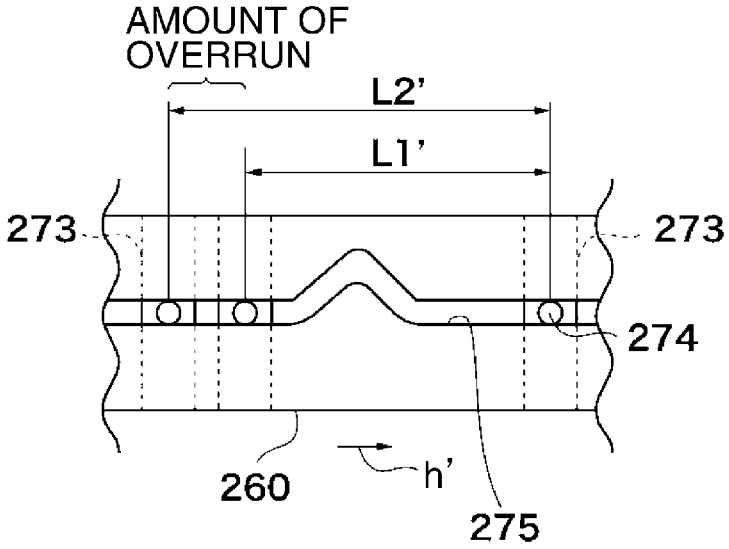
FIG. 9 is a view showing a change in positional relation between the cam groove and the punch at the punching operation.

FIG. 9 shows a change in positional relation between one of the cam grooves 275 and the corresponding punch 273 at the punching operation. As compared to the initial operation shown in FIG. 8, the slider 260 is moved in an opposite direction (shown by arrow h' in FIG. 9) in the punching operation. As with the initial operation, the punch motor 221 even applied with brake overruns to a rotational position corresponding to a distance L2' larger than a distance L1' from a movement start position to a target stop position. An amount of overrun (corresponding to the distance difference (L2'–L1')) corresponds to an actual stop position of the slider 260, and corresponds to the time period ΔT1 shown in FIG. 7.

In the next punching operation (i.e., in the punching operation on the next sheet), the post-processing apparatus controller 501 starts the punch motor 221 at a timing earlier by the time period ΔT1 than the stop timing of the conveyance motor 208. In this way, the start timing of each punching operation (i.e., the start timing of the punching operation on each sheet) is properly determined in advance based on the amount of overrun determined in the preceding punching operation (i.e., in the punching operation on the preceding sheet). In other words, the time period ΔT1 is used as a correction value for the start timing of the punch motor 221.

Figure 10:
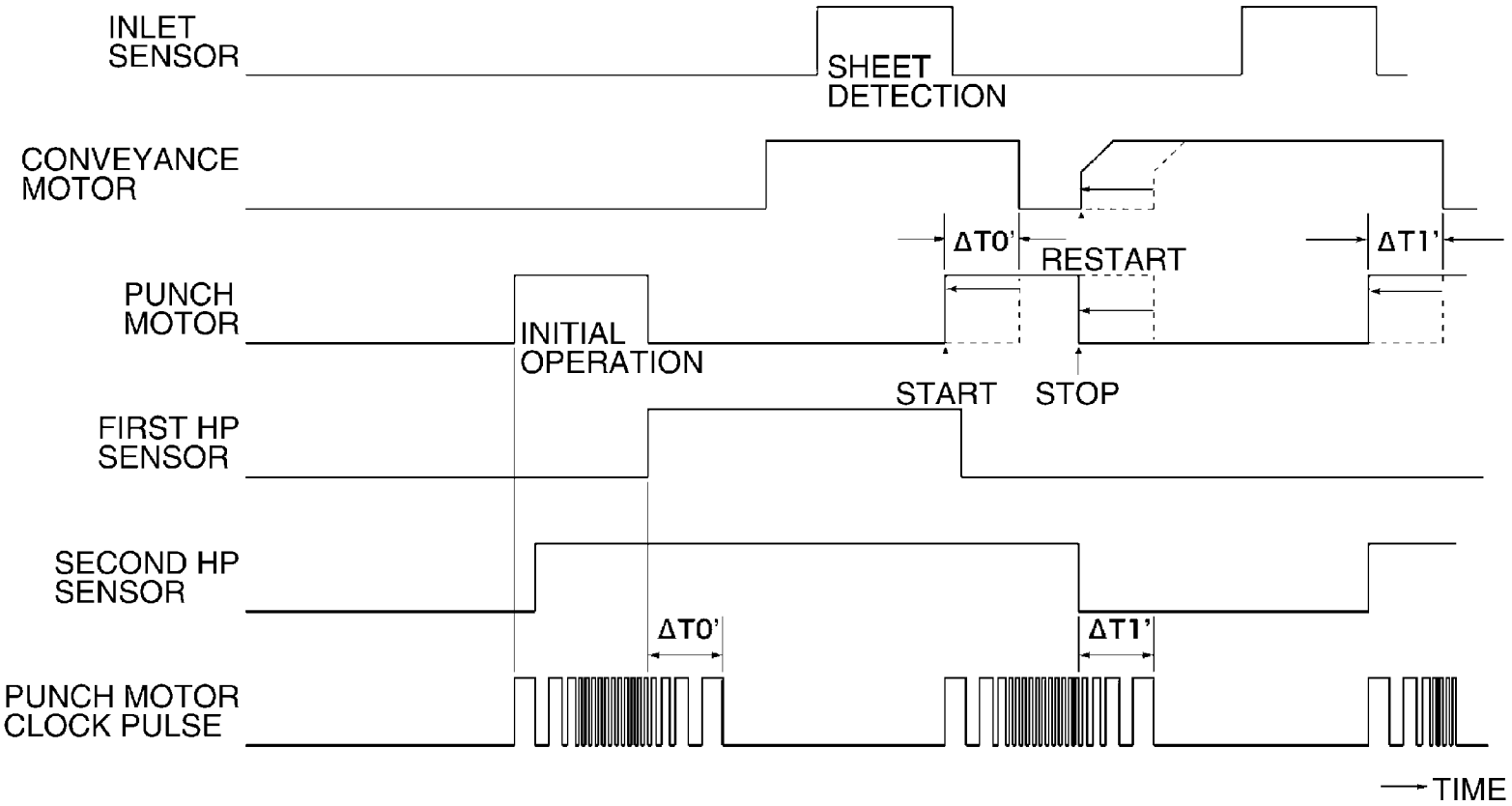
FIG. 10 is a timing chart showing changes of signals at various parts of the punch unit in a case that the initial operation is started from a state where the slider is stopped at a position shown in FIG. 5A and a punching operation is performed in succession to the initial operation.

FIG. 10 is a timing chart showing changes of signals at various parts of the punch unit in a case that the initial operation is performed from a state where the slider 260 is stopped at the position shown in FIG. 5A and the punching operation is performed in succession to the initial operation. In the initial operation, the time period ΔT0' is determined while moving the slider 260 from the position shown in FIG. 5A to the position shown in FIG. 3A. In the punching operation, the punch motor 221 is started at a timing earlier by the time period ΔT0' than a stop timing of the conveyance motor 208 to move the slider 260 from the position shown in FIG. 3A to the position shown in FIG. 5A to thereby punch a sheet, and a time period ΔT1' is obtained that is used to determine a start timing of the punch motor 221 in the next punching operation. Signals at various parts change as shown in FIG. 10 in substantially the same manner as those shown in FIG. 7, and therefore a description thereof is omitted.

Figure 11:
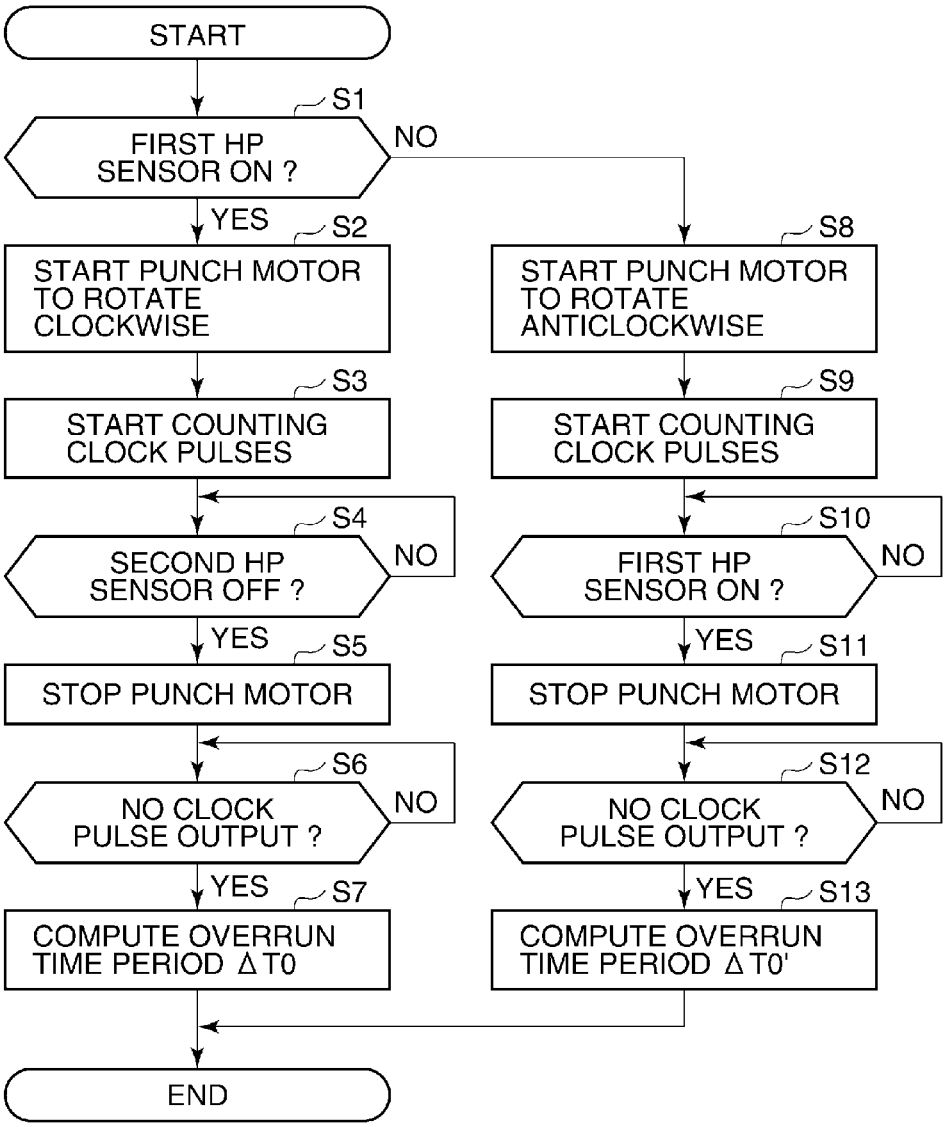
FIG. 11 is a flowchart showing the procedures of the initial operation.

FIG. 11 shows in flowchart the procedures of the initial operation. A control program for the initial operation is stored in the ROM 402 and executed by the CPU 401 of the post-processing apparatus controller 501. The initial operation, which includes checking whether the punch unit 250 normally operates, is performed after a copy start instruction being given by a user and before a sheet being conveyed into the post-processing apparatus 100.

First, the CPU 401 determines whether the first HP sensor 271 is ON, i.e., whether the slider 260 is stopped at the position shown in FIG. 3A (step S1).

If the first HP sensor 271 is ON, the CPU 401 performs the initial operation shown in FIG. 7. Specifically, the CPU 401 outputs to the punch motor driver 279 a punch motor start signal that causes the punch motor 221 to rotate clockwise (step S2). When receiving the punch motor start signal, the punch motor driver 279 drives the punch motor 221. Next, the CPU 401 starts inputting clock pulses from the punch motor clock sensor 276 (step S3). Then, the CPU 401 determines whether the second HP sensor 272 is OFF, i.e., whether the light interception member of the slider 260 gets out of the sensor 272 (step S4). If the second HP sensor 272 is OFF, the CPU 401 outputs a punch motor stop signal to the punch motor driver 279, thereby stopping the punch motor 221 (step S5). Thus, the CPU 401 functions as a stop control unit for stopping the motor.

Next, the CPU 401 waits for the punch motor 221 to completely stop, so that the punch motor clock pulse is no longer output (step S6). When determining that the punch motor clock pulse is no longer output, the CPU 401 computes a time period ΔT0 (see, FIG. 7) based on the number of clock pulses (amount of overrun) supplied from when the second HP sensor 272 was turned OFF to when the motor completely stops (step S7). Thus, the CPU 401 functions as a conversion unit for converting the amount of overrun (the number of clock pulses) into the time period ΔT0. Subsequently, the CPU 401 completes the present process.

On the other hand, if it is determined in step S1 that the first HP sensor 271 is not ON, i.e., if the slider 260 is stopped at the position shown in FIG. 5A, the CPU 401 performs the initial operation shown in FIG. 10. Specifically, the CPU 401 outputs a punch motor start signal that causes the punch motor 221 to rotate anticlockwise (step S8), and starts inputting clock pulses from the punch motor clock sensor 276 (step S9).

Next, the CPU 401 determines whether the first HP sensor 271 is turned ON (step S10). If the sensor 271 is turned ON, i.e., if the slider 260 is moved to reach the position shown in FIG. 3A, the CPU 401 outputs a punch motor stop signal to thereby stop the punch motor 221 (step S11).

Then, the CPU 401 waits for the punch motor 221 to completely stop, so that the punch motor clock pulse is no longer output (step S12). When determining that the punch motor clock pulse is no longer output, the CPU 401 computes a time period ΔT0' (see, FIG. 10) based on the number of clock pulses (amount of overrun) from when the first HP sensor 271 was turned ON to when the motor completely stops (step S13). Subsequently, the CPU 401 completes the present process.

Figure 12:
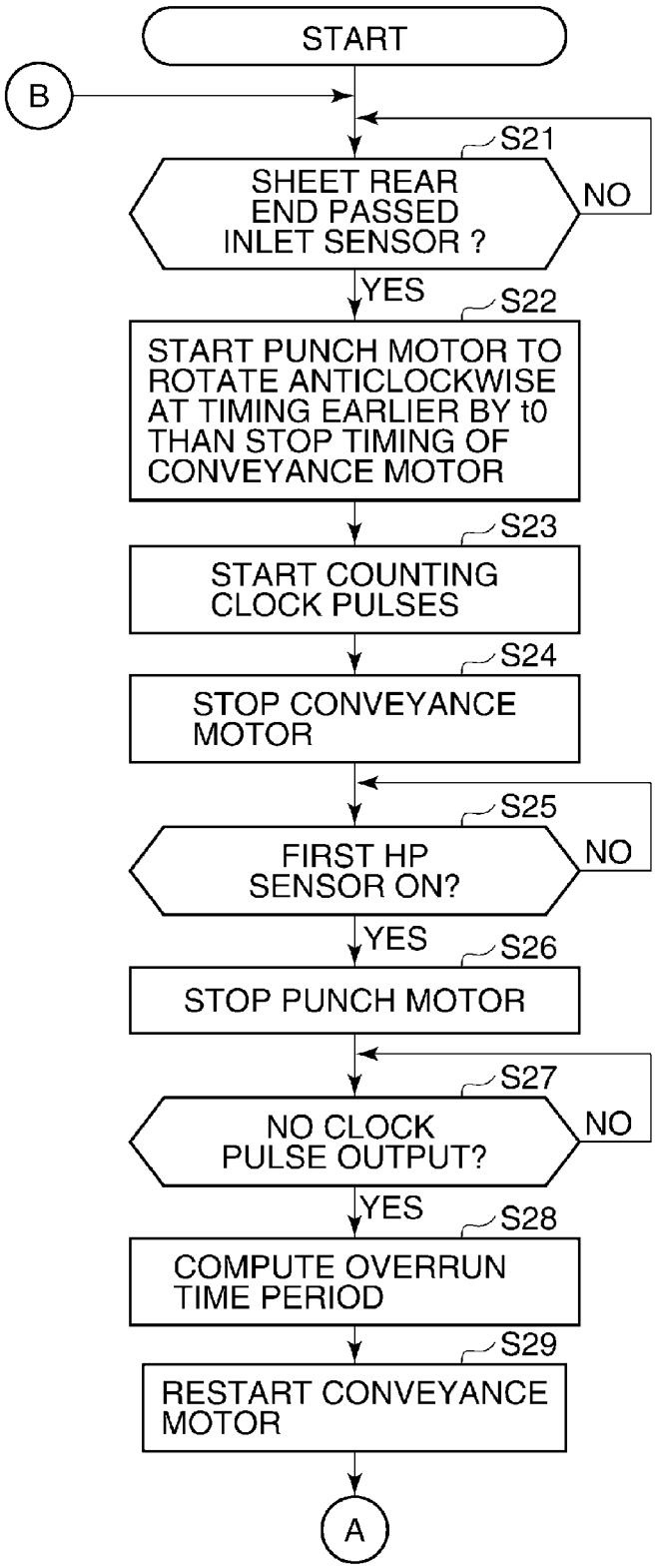
FIG. 12 is a flowchart showing a part of the procedures of punching operation started from a state where the slider is stopped at the position shown in FIG. 5A.
Figure 13:
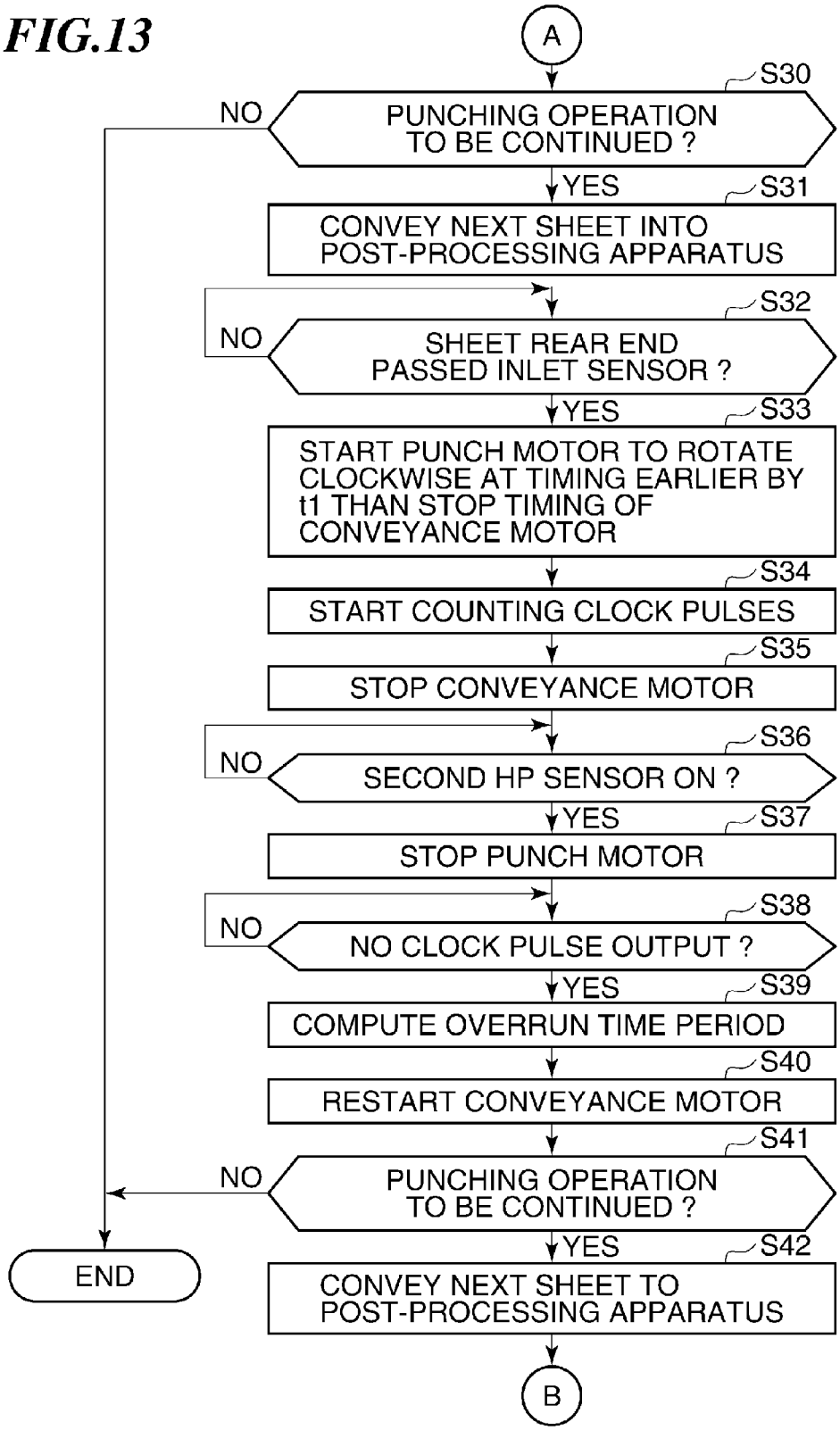
FIG. 13 is a flowchart showing the remaining part, that follows the part shown in FIG. 12, of the procedures of the punching operation.

FIGS. 12 and 13 are a flowchart showing the procedures of the punching operation started from a state where the slider 260 is stopped at the position shown in FIG. 5A. A control program for the punching operation is stored in the ROM 402 and executed by the CPU 401 of the post-processing apparatus controller 501.

First, the CPU 401 determines whether a rear end of a sheet has passed the inlet sensor 101 (step S21). If the answer to step S21 is NO, the CPU 401 repeats the determination in step S21. On the other hand, if the sheet rear end has passed the inlet sensor 101, the CPU 401 outputs, at a timing earlier by a time period t0 than a stop timing of the conveyance motor 208, a punch motor start signal that causes the punch motor 221 to rotate anticlockwise (step S22). Next, the CPU 401 starts inputting clock pulses from the punch motor clock sensor 276 (step S23), and stops the conveyance motor 208 (step S24).

It should be noted that in a case where the punching operation is performed not for the first time after power-on of the image forming apparatus, the time period t0 is computed based on the amount of overrun in the preceding punching operation. On the other hand, if the punching operation is performed for the first time after the power on of the apparatus, the time period t0 (equal to the time period ΔT0 shown in FIG. 7) is computed in the initial operation.

Next, the CPU 401 determines whether the first HP sensor 271 is ON, i.e., whether the slider 260 is at the position shown in FIG. 3A (step S25). If the first HP sensor 271 is not ON, the CPU 401 repeats the determination in step S25. On the other hand, if the first HP sensor 271 is ON, the CPU 401 outputs a punch motor stop signal to stop the punch motor 221 (step S26), and determines whether the punch motor 221 completely stops, so that the punch motor clock pulse is no longer output (step S27). If the clock pulse is still output, the CPU 401 repeats the determination in step S27.

When determining that the clock pulse is no longer output, the CPU 401 computes the time period t1 based on the number of clock pulses (amount of overrun) from when the first HP sensor 271 was turned ON to when the motor completely stops (step S28). Then, the CPU 401 outputs a conveyance motor start signal to restart the conveyance motor 208 (step S29), whereby the punched sheet is conveyed toward the downstream of the punch unit 250.

Next, the CPU 401 determines whether the punching operation is to be continued (step S30). If the punching operation is not to be continued, the CPU 401 completes the present process. On the other hand, if the punching operation is to be continued, the CPU 401 causes the next sheet to be conveyed into the post-processing apparatus 100 (step S31).

After the next sheet is conveyed into the post-processing apparatus 100, the CPU 401 waits for the sheet rear end to pass through the inlet sensor 101 (step S32). When determining that the sheet rear end has passed the inlet sensor 101, the CPU 401 outputs, at a timing earlier by a time period t1 than a stop timing of the conveyance motor 208, a punch motor start signal that causes the punch motor 221 to rotate clockwise (step S33). Thus, the CPU 401 functions as a timing decision unit to decide a start timing of the punch motor 221. Next, the CPU 401 starts inputting clock pulses from the punch motor clock sensor 276 (step S34), and stops the conveyance motor 208 (step S35). It should be noted that the time period t1 corresponds to the amount of overrun in the preceding punching operation, and is updated each time the punching operation is completed.

Next, the CPU 401 determines whether the second HP sensor 272 is turned OFF (step S36). If the second HP sensor 272 is turned OFF, the CPU 401 outputs a punch motor stop signal to stop the punch motor 221 (step S37). Then, the CPU 401 determines whether the punch motor 221 completely stops, so that the punch motor clock pulse is no longer output (step S38). When determining that the clock pulse is still output, the CPU 401 repeats the determination in step S38. On the other hand, when determining that the punch motor clock pulse is no longer output, the CPU 401 computes an overrun time period from when the second HP sensor 272 was turned OFF to when the motor completely stops (step S39). Subsequently, the CPU 401 outputs a conveyance motor start signal to restart the conveyance motor 208 (step S40), whereby the punched sheet is conveyed toward the downstream of the punch unit 250.

Then, the CPU 401 determines whether the punching operation is to be continued (step S41). If the punching operation is not to be continued, the CPU 401 completes the present process. On the other hand, if the punching operation is to be continued, the CPU 401 causes the next sheet to be conveyed into the post-processing apparatus 100 (step S42), and returns to step S21. The CPU 401 executes the above-described operation procedures until completion of the punching operation.

Figure 14:
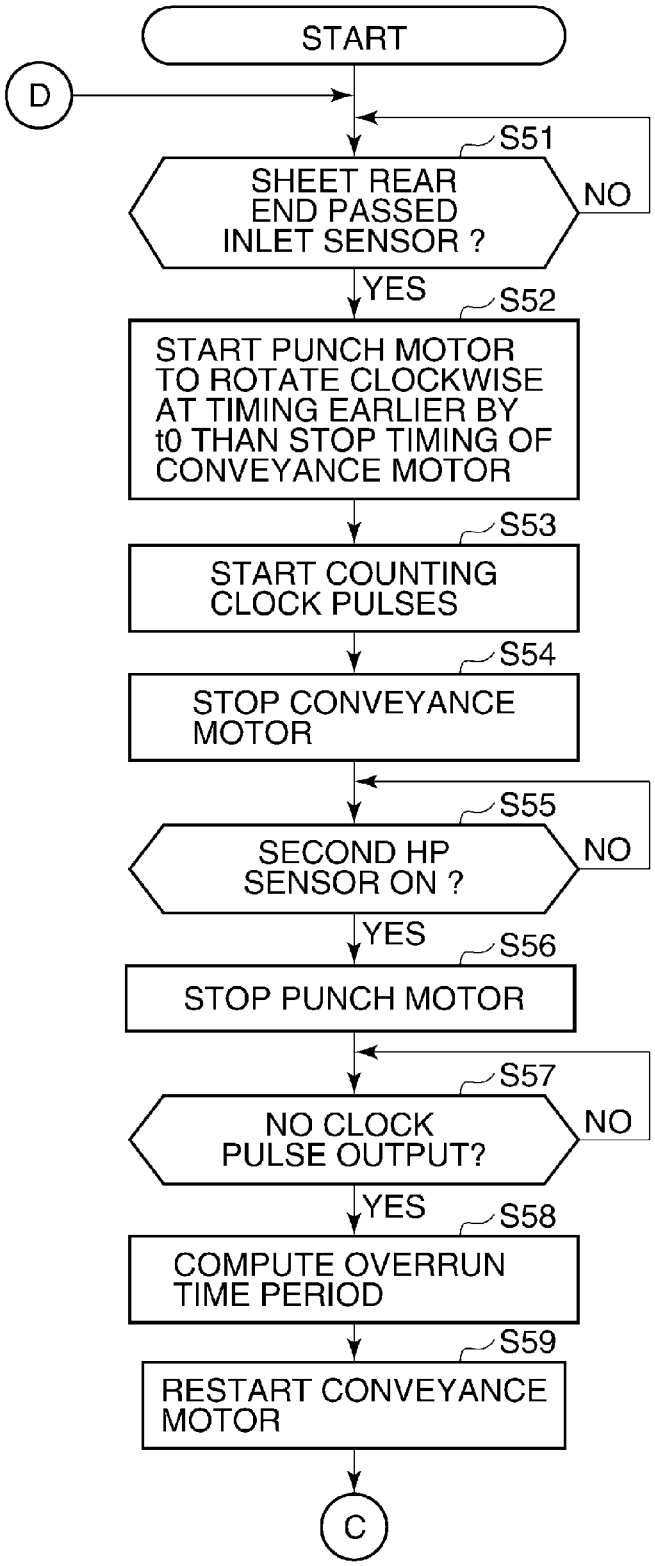
FIG. 14 is a flowchart showing a part of the procedures of punching operation started from a state where the slider is stopped at the position shown in FIG. 3A.
Figure 15:
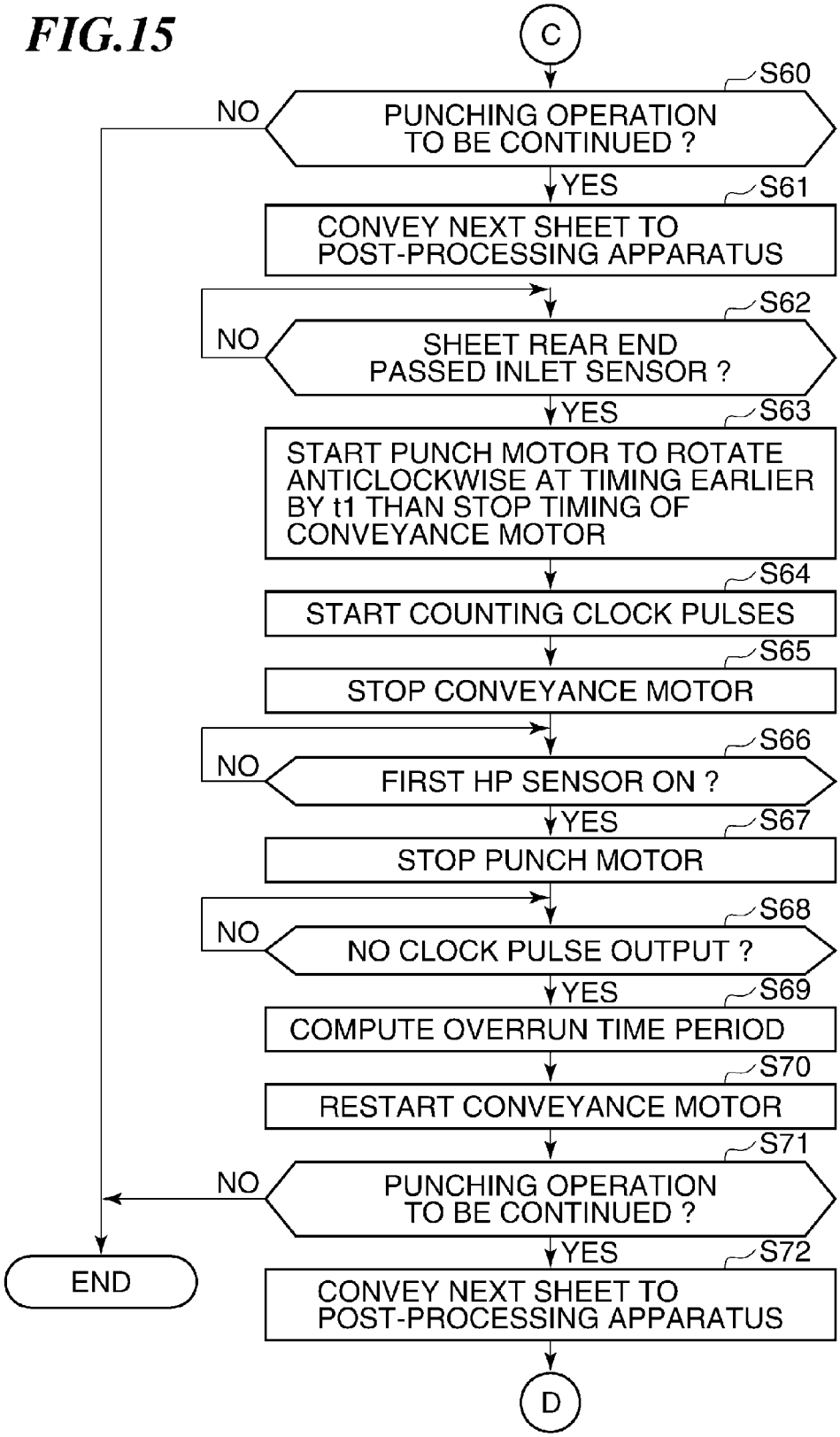
FIG. 15 is a flowchart showing the remaining part, that follows the part shown in FIG. 14, of the procedures of the punching operation.
Figure 16:
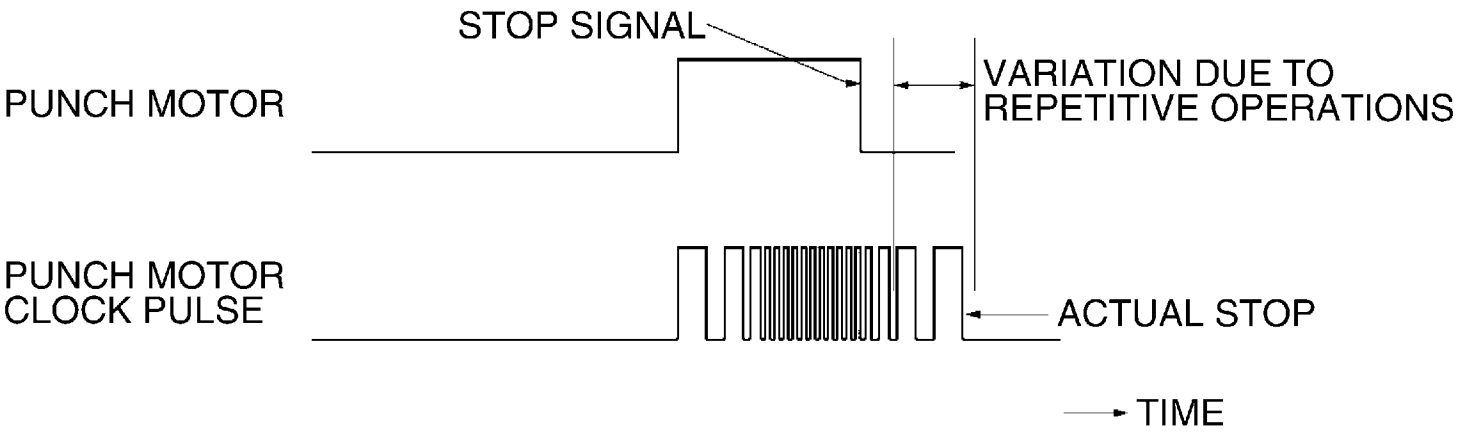
FIG. 16 is a timing chart showing a punch motor stop operation that entails a variation in motor stop position due to repetitive operations.

FIGS. 14 and 15 are a flowchart showing the procedures of punching operation started from a state where the slider 260 is stopped at the position shown in FIG. 3A. A control program for the punching operation is stored in the ROM 402 and executed by the CPU 401 of the post-processing apparatus controller 501.

First, the CPU 401 determines whether a rear end of a sheet has passed the inlet sensor 101 (step S51). If the answer to step S51 is NO, the CPU 401 repeats the determination in step S51. On the other hand, if the sheet rear end has passed the inlet sensor 101, the CPU 401 outputs, at a timing earlier by a time period t0 than a stop timing of the conveyance motor 208, a punch motor start signal that causes the punch motor 221 to rotate clockwise (step S52). Next, the CPU 401 starts inputting clock pulses from the punch motor clock sensor 276 (step S53), and stops the conveyance motor 208 (step S54).

It should be noted that in a case where the punching operation is performed not for the first time after power-on of the image forming apparatus, the time period t0 is computed based on the amount of overrun in the preceding punching operation. On the other hand, if the punching operation is performed for the first time after power-on of the apparatus, the time period t0 (equal to the time period ΔT0' shown in FIG. 10) is computed in the initial operation.

Next, the CPU 401 determines whether the second HP sensor 272 is OFF, i.e., whether the slider 260 is at the position shown in FIG. 5A (step S55). If the first HP sensor 272 is not OFF, the CPU 401 repeats the determination in step S55. On the other hand, if the second HP sensor 272 is OFF, the CPU 401 outputs a punch motor stop signal to stop the punch motor 221 (step S56), and determines whether the punch motor 221 completely stops, so that the punch motor clock pulse is no longer output (step S57). If the clock pulse is still output, the CPU 401 repeats the determination in step S57.

When determining that the clock pulse is no longer output, the CPU 401 computes the time period t1 based on the number of clock pulses (amount of overrun) from when the second HP sensor 272 was turned OFF to when the motor completely stops (step S58). Then, the CPU 401 outputs a conveyance motor start signal to restart the conveyance motor 208 (step S59), whereby the punched sheet is conveyed toward the downstream of the punch unit 250.

Next, the CPU 401 determines whether the punching operation is to be continued (step S60). If the punching operation is not to be continued, the CPU 401 completes the present process. On the other hand, if the punching operation is to be continued, the CPU 401 causes the next sheet to be conveyed into the post-processing apparatus 100 (step S61).

After the next sheet is conveyed into the post-processing apparatus 100, the CPU 401 waits for the sheet rear end to pass through the inlet sensor 101 (step S62). When determining that the sheet rear end has passed the inlet sensor 101, the CPU 401 outputs, at a timing earlier by a time period t1 than a stop timing of the conveyance motor 208, a punch motor start signal that causes the punch motor 221 to rotate anti-clockwise (step S63). Next, the CPU 401 starts inputting clock pulses from the punch motor clock sensor 276 (step S64), and stops the conveyance motor 208 (step S65). It should be noted that the time period t1 corresponds to the amount of overrun in the preceding punching operation, and is updated each time the punching operation is completed.

Next, the CPU 401 determines whether the first HP sensor 271 is turned ON (step S66). If the first HP sensor 271 is turned ON, the CPU 401 outputs a punch motor stop signal to stop the punch motor 221 (step S67).

Then, the CPU 401 determines whether the punch motor 221 completely stops, so that the punch motor clock pulse is no longer output (step S68). When determining that the punch motor clock pulse is still output, the CPU 401 repeats the determination in step S68. On the other hand, when determining that the punch motor clock pulse is no longer output, the CPU 401 computes an overrun time period from when the first HP sensor 271 was turned ON to when the motor completely stops (step S69). Subsequently, the CPU 401 outputs a conveyance motor start signal to restart the conveyance motor 208 (step S70), whereby the punched sheet is conveyed toward the downstream of the punch unit 250.

Then, the CPU 401 determines whether the punching operation is to be continued (step S71). If the punching operation is not to be continued, the CPU 401 completes the present process. On the other hand, if the punching operation is to be continued, the CPU 401 causes the next sheet to be conveyed into the post-processing apparatus 100 (step S72), and returns to the processing of step S51. The CPU 401 executes the above-described operation procedures until completion of the punching operation.

The sheet punching apparatus of this embodiment computes an actual stop position of the slider 260, and changes a start timing (i.e., distance) of the next movement of the slider 260 according to the computed stop position, thereby improving the accuracy of movement distance of the slider 260. As a result, a motor drive time from the start of the punch motor until the motor reaches a stop position can be minimized, and the durability of the punch motor can be improved. In addition, the productivity in sheet punching can be made higher than in a case where the punch motor is started after completion of sheet conveyance. Even when the punch motor comprised of a DC motor is used, the accuracy of movement distance of the motor and the durability of the motor can be improved.

In the initial operation, it is possible to decide a start timing of movement of the slider (movement start timing) while checking whether the sheet punching apparatus normally operates, whereby an immediate shift to the sheet punching operation can be realized.

Since the start timing is updated each time a sheet is punched, a highly accurate movement distance of the slider 260 can be maintained, irrespective of a state of the motor. In this embodiment, a sheet can be punched by simply moving the slider 260 in a predetermined direction.

It should be noted that this invention is not limited to the above-described embodiment. For example, as image forming apparatuses to which the sheet punching apparatus of this invention is applied, there may be mentioned a printing apparatus, a facsimile machine having a printing function, and a multi-function peripheral having a printing function, copy function, scanner function, and the like.

In the above-described embodiment, the image forming apparatus using an electrophotographic printing method has been described by way of example, however, this invention is also applicable to image forming apparatuses using various printing methods such as an ink jet method, thermal transfer method, thermography method, electrostatic method, and discharge breakdown method.

Shapes and relative positions of component parts described in the above embodiment are not limitative, and can be modified according to the construction of an apparatus to which this invention is applied and according to various conditions.

A sheet to be punched is not limited in material and in shape, and may be paper medium, OHP sheet, heavy sheet, tab sheet, etc.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-257180, filed Nov. 10, 2009, which is hereby incorporated by reference herein in its entirety.

What is claimed is:

1. A control method of a sheet punching apparatus having a conveyance unit, a punch, a movable member, a drive unit, a position detection unit, and a control unit, the method comprising:

a conveyance step of conveying, with the conveyance unit, the sheet to a punching processing position at which the sheet is punched;

a punch step of punching, with the punch, the conveyed sheet at the punching processing position;

a drive step of reciprocating, with the drive unit, the movable member;

a position detection step of detecting, with the position detection unit, whether or not the movable member is at a predetermined position;

a stop control step of, with the control unit, in response to the position detection step detecting that the movable member reaches the predetermined position after movement of the movable member is started in said drive step, stopping an operation of the drive unit to thereby stop the movement of the movable member and determining a start timing of movement of the movable member for the next punching of the punch based on a position where the movable member is stopped, said start timing being earlier than a timing of the next sheet stopping at the punching processing position.

2. A sheet punching apparatus for punching a sheet, the sheet punching apparatus comprising:

a conveyance unit configured to convey the sheet to a punching processing position at which the sheet is punched;

a punch configured to punch the conveyed sheet at the punching processing position;

a movable member configured to reciprocate to thereby move said punch;

a drive unit configured to reciprocate said movable member;

a position detection unit configured to detect whether or not said movable member is at a predetermined position;

a control unit configured to, in response to said position detection unit detecting that said movable member reaches the predetermined position after movement of said movable member is started by said drive unit, stop an operation of said drive unit to thereby stop the movement of said movable member and determine a start timing of movement of said movable member for the next punching of said punch based on a position where said movable member is stopped, said start timing being earlier than a timing of the next sheet stopping at the punching processing position.

3. The sheet punching apparatus according to claim 2, wherein said control unit controls said drive unit to control the movement of said movable member so that the start timing of the movement of said movable member is earlier when a difference between the predetermined position and the position where said movable member is stopped is a first value than when the difference is a second value, which is less than the first value.

4. A sheet punching apparatus comprising:

a punch configured to punch a sheet by being moved;

a movable member configured to move in a predetermined direction to thereby move said punch;

a drive unit configured to move said movable member in the predetermined direction;

a position detection unit configured to detect that said movable member is at a predetermined position;

a stop control unit configured, in response to said position detection unit detecting that said movable member reaches the predetermined position after movement of said movable member is started by said drive unit, to stop an operation of said drive unit to thereby stop the movement of said movable member; and a timing decision unit configured to decide a next start timing of movement of said movable member based on a position where said movable member is stopped by said stop control unit, wherein said timing decision unit includes a movement amount detection unit configured to detect a first movement amount from start of movement of said movable member until said movable member reaches the predetermined position and detect a second movement amount from start of movement of said movable member until said movable member is stopped, and wherein said timing decision unit decides the next start timing of movement of said movable member based on a difference between the first and second movement amounts detected by said movement amount detection unit.

5. The sheet punching apparatus according to claim 4, wherein said timing decision unit makes the next start timing of movement earlier as the difference between the first and second movement amounts detected by said movement amount detection unit becomes larger.

6. The sheet punching apparatus according to claim 2, wherein said position detection unit detects a first position as the predetermined position when said movable member moves forward, and detects a second position as the predetermined position when said movable member moves backward.

7. The sheet punching apparatus according to claim 2, wherein in an initial operation performed before punching a first sheet, said control unit controls said drive unit to move and stop the movable member, and determines the start timing of movement based on the position where said movable member is stopped.

8. The sheet punching apparatus according to claim 2, wherein said control unit determines the start timing of movement of the movable member for punching of a next sheet each time a sheet is punched.

9. The sheet punching apparatus according to claim 2, wherein:

said movable member is formed with a cam groove into which a projection formed on said punch is inserted, so that said punch is moved according to a moving position of said movable member, and said drive unit moves said movable member to thereby move said punch so that the projection moves along the cam groove while the sheet is punched.

* * * * *